US005356489A

United States Patent [19]

Nozieres et al.

[11] Patent Number: 5,356,489

[45] Date of Patent: Oct. 18, 1994

[54] PROCESS FOR THE PREPARATION OF PERMANENT MAGNETS BASED ON NEODYMIUM-IRON-BORON

[75] Inventors: Jean P. Nozieres, Seyssins; Renë P. De La Bathie, Saint Pierre D'Albigny; Marc Lelievre, Eybens, all of France

[73] Assignee: Centre National de la Recherche Scientifique and La Pierre Synthetique Balkiwski, France

[21] Appl. No.: 777,547

[22] PCT Filed: Jun. 21, 1990

[86] PCT No.: PCT/FR90/00452

§ 371 Date: Dec. 12, 1991

§ 102(e) Date: Dec. 12, 1991

[87] PCT Pub. No.: WO91/00602

PCT Pub. Date: Jan. 10, 1991

[30] Foreign Application Priority Data

Jun. 23, 1989 [FR] France ..... 8908657

[51] Int. Cl.[5] ..... H01F 1/02

[52] U.S. Cl. ..... 148/101; 148/120

[58] Field of Search ..... 148/101, 102, 120

[56] References Cited

U.S. PATENT DOCUMENTS

| | | | |
|---|---|---|---|
| 4,921,551 | 5/1990 | Vernia et al. | 148/101 |
| 5,055,142 | 10/1991 | dela Bathie et al. | 148/101 |
| 5,125,988 | 6/1992 | Akioka et al. | 148/101 |

OTHER PUBLICATIONS

A Dictionary of Metallurgy, 1958 pp. 98, 386 and 387, A. D. Merriman.

Shimoda et al., "High-energy cast Pr-Fe-B Magnets" J. Appl. Phy. vol. 64, No. 10, Nov. 15, 1988, pp. 5290-5292.

*Primary Examiner*—John P. Sheehan

*Attorney, Agent, or Firm*—Harris Beach & Wilcox

[57] ABSTRACT

The present invention is a process for the preparation of copper-neodymium-iron-boron permanent magnets. The process comprises forging a cast bulk copper-neodymium-iron-boron alloy in a temperature range in which the alloy exists in two phases, a first solid phase and a second liquid phase.

21 Claims, 1 Drawing Sheet

PROCESS FOR THE PREPARATION OF PERMANENT MAGNETS BASED ON NEODYMIUM-IRON-BORON

The present invention relates to a novel improved process, with a view to the preparation of high performance permanent magnets based on neodymium-iron-boron. More particularly it relates to a process for manufacturing permanent magnets by the technical process called welding.

By "welding" is denoted a mechanical treatment applied to a metallic alloy and intended to cause the refinement of the constituent grains of this alloy. The welding is defined then by its deformation rate. The mechanical treatments capable of inducing welding are essentially forging, hammering, rolling, drawing, vibrocompacting (compacting by vibration) etc.

BACKGROUND OF THE INVENTION

In European Patent EP-A-0,106,948 is described a process for obtaining magnets based on iron-cobalt-boron-rare earths alloy by the technique called powder metallurgy. While indeed the magnets obtained do have interesting magnetic properties, this process, on the other hand, proves to be particularly complicated and dangerous, in fact it requires numerous precautions to be taken, and especially working under a controlled atmosphere. Moreover, the cost of the magnets thus obtained is relatively high. Finally, while indeed the use of cobalt in the base mixture enables the Curie temperature to be increased quite significantly, and therefore the use temperature of these magnets, on the other hand, a reduction in the coercivity and magnetic properties in general are observed.

In the publication by SHIMODA et al. (J. Appl. Phys. 64 (10) 1988), it is proposed to produce permanent magnets based on a praseodymium-iron-boron-copper mixture and this is achieved with a low deformation ratio, especially less than ten. This production process is carried out by hot pressing under an inert atmosphere at approximately 1,000° C. However, this process enables enhanced magnetic properties to be obtained for small magnets only. What i s more, taking into account their production process especially by sheath rolling, resulting indeed in a refinement of the grains (insufficient, however, with a deformation ratio less than ten), with an inhomogeneous microstructure and a magnetic orientation, only praseodymium enables good results to be obtained. It has been shown in fact that by replacing the praseodymium by neodymium, the magnetic properties fall off drastically, making the addition of copper totally pointless. Now praseodymium is much rarer in the earth's surface than neodymium, hence a cost of magnets based on praseodymium distinctly higher (typically in a ratio of 5 to 1 in relation to neodymium) .

There has also been described a hot welding process in European Patent EP-A-0,269,667 making it possible to obtain, under extensive safety conditions, permanent magnets on an industrial scale showing good magnetic performance. These magnets, based on iron-boron and rare earths have a relatively low production cost, taking into account the process used. Nevertheless, it is desirable to improve their magnetic properties. And this is the object of the present invention.

SUMMARY OF THE INVENTION

The present invention relates to an improved process for the preparation of high-performance permanent magnets from a bulk alloy containing a mixture based on iron-boron and neodymium which, for a temperature range, has a region in which the said alloy occurs as two phases, the one a solid and brittle phase and the other a liquid phase, which process consists:

- in partially substituting iron and/or neodymium atoms of the said alloy by copper atoms,
- then, in welding the novel alloy thus produced at a temperature within the said temperature range so as to obtain a deformation rate of at least ten, in such a manner as to refine the constituent grains of the said alloy into particles of a few micrometers;
- and, finally, in subjecting the alloy thus welded to an annealing and/or tempering treatment.

In other words, the present invention consists in replacing, in a bulk alloy based on neodymium-iron-boron, some of the iron and/or neodymium atoms by copper atoms and then in subjecting this alloy to a hot welding treatment. While indeed the use of copper was known per se with a view to improving certain magnetic properties, it was clearly shown, on the other hand, that the use of copper in an iron-boron rare earth alloy, in which the rare earth was neodymium, did not enable permanent magnets having enhanced magnetic properties obtained.

Advantageously, in practice:

- the alloy comprises 0.5 to 4 atomic % of copper; in fact it has been found that if the atomic quantity of copper is less than 0.5% a fall-off is observed in the magnetic properties of the magnet thus produced. In other words a significant improvement in relation to the magnets obtained according to the process described in the European Patent EP-A-0,269,667 was not observed. On the other hand, if the quantity of copper exceeds 4 atomic % the remanence is affected because of the reduction in the quantity of magnetic material;
- the alloy comprises 1 to 2.5 atomic % of copper, preferably 2%;
- the alloy based on neodymium-iron-boron-copper also comprises dysprosium (Dy);
- dysprosium is present at a level of 0.5 atomic % to 2 atomic %.

The manner in which the invention may be carried out and the advantages which result therefrom will become clearer from the embodiments which follow, given by way of non-limiting indication in support of the attached figure.

The various examples which follow show the production of permanent magnets, on the one hand, in accordance with the invention by means of a relatively simple arrangement such as is especially described in European Patent EP-A-0,269,667 and, on the other hand, and by way of comparison, in accordance with the process described in the publication J. Appl. Phys. 64 (10).

Figure 1:
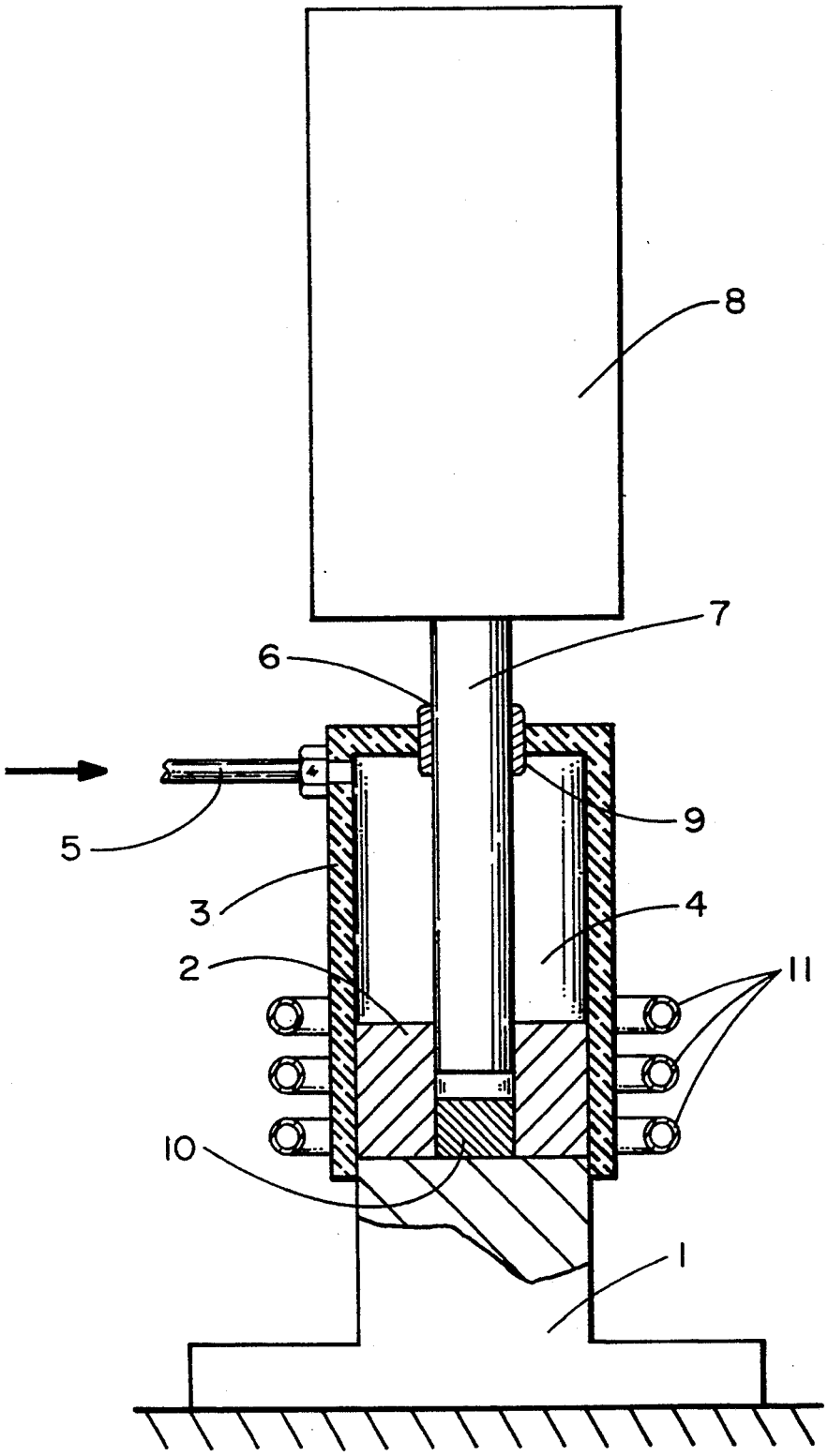
FIG. 1 is a depiction of a forging device that can be used in the process of this invention.

In summary, and as may be seen in FIG. 1, the arrangement according to the invention comprises an anvil (1) on which a retention ring (2) rests, surrounded by a glass enclosure (3), defining a leaktight chamber (4), connected to the inlet (5) of a source of argon (not shown). The top of the chamber comprises an opening (6) through which the hammer (7) of the outer strike assembly (8) may pass, via a gasket (9). The specimen (10) rests on the anvil (1) inside the ring (2) in which the hammer (7) slides. The glass enclosure (3) is surrounded by induction heating coils (11).

EXAMPLE 1

A bulk specimen (disk, cylinder, casting . . . , pellets) is prepared in an alloy constituted by a mixture of iron, neodymium, boron and aluminum. The atomic concentration per 100 atoms of alloy of the various elements is:

76 iron atoms,
16 neodymium atoms,
6 boron atoms,
2 aluminum atoms.

This bulk specimen thus constituted is placed on the anvil (1) of the arrangement, inside the ring (2). Argon is then injected at (5) and the leaktight chamber (4) is heated by induction (11) to 800° C. for five minutes. When this temperature is reached, the specimen (10) is hammered by three hammer blows. This forging thus carried out induces a deformation rate of approximately ten, sufficient to shatter the magnetic crystals.

An annealing is then carried out, under neutral gas or possibly under vacuum, at a temperature of 650° C.

The magnetic element thus obtained has an intrinsic coercive field of 756 kiloamps per meter (756 kA/m) and a remanent induction of 0.8 Tesla. The maximum energy product obtained in this case is of the order of 103.5 kilojoules per cubic meter (103.5 kJ/m$^3$).

The element obtained has, in a known manner, a tetragonal crystalline structure.

EXAMPLE 2

The Example 1 is repeated, but in which two aluminum atoms are substituted by two cobalt atoms. The specimen is subjected to the same treatment, an intrinsic coercive field is then obtained of 597 kA/m for an emanent [sic]induction of 0.88 Tesla. A significant fall-off in the coercive field and a slight increase in the remanent induction are therefore found. The role of the cobalt is essentially to increase the Curie temperature and therefore the use temperature of the permanent magnets thus produced.

EXAMPLE 3

The Example 1 is repeated, but in which the base alloy is only a ternary mixture of neodymium, iron and boron. The atomic composition per 100 atoms of the mixture is:

16 neodymium atoms,
78 iron atoms,
6 boron atoms.

The intrinsic coercive field obtained is then 600 kA/m and the remanent induction 0.9 Tesla. The maximum energy product obtained is, in this case, approximately 95.5 kJ/m$^3$.

EXAMPLE 4

Permanent magnets are then produced by the process called "hot pressing". The production process and the composition of the base alloy are described in the publication (SHIMODA et al.) mentioned hereinabove J. Appl. Phy. 64 (10). This example and the two which follow are given by way of comparison.

In the present case, the atomic centesimal composition of the base mixture is:

17 praseodymium atoms,
7.5 iron atoms,
5 boron atoms,
1.5 copper atoms.

The intrinsic coercive field obtained is 800 kA/m and the remanent induction is 1.25 Tesla. The maximum energy product obtained is 288 kJ/m$^3$.

It is observed, therefore, that according to this process and with this composition excellent anisotropic magnets are obtained.

EXAMPLE 5

The same process is used but the centesimal composition of the initial mixture is:

17 neodymium atoms,
76.5 iron atoms,
5 boron atoms,
1.5 copper atoms.

The intrinsic coercive field obtained is 230 kA/m and the remanent induction is 0.19 Tesla. The maximum energy product obtained is 72.8 kJ/m$^3$. A drastic fall-off in the magnetic properties is thus observed when praseodymium is replaced by neodymium.

EXAMPLE 6

In the same publication, recourse is made to another process called casting. This process applied to the composition of the previous example enables permanent magnets to be obtained with an intrinsic coercive field of 48 kA/m for a remanent induction of 0.29 Tesla. The maximum energy product obtained is 3.2 kJ/m$^3$. It is observed, therefore, that according to either of the processes used within the scope of that publication, the fact of introducing copper into the neodymium-iron-boron mixture, far from increasing the magnetic properties of the magnets thus obtained, causes, on the contrary, a fall-off of the latter.

EXAMPLE 7

The process according to the invention is repeated by using as centesimal composition of the base mixture:

17 neodymium atoms,
76 iron atoms,
5 boron atoms,
2 copper atoms.

The intrinsic coercive field obtained is 950 kA/m and the remanent induction 1.01 Tesla. A maximum energy product of approximately 200 kJ/m$^3$ is thus obtained. Excellent anisotropic permanent magnets of very high performance are then obtained.

EXAMPLE 8

The previous example is repeated with the atomic centesimal composition of the following [sic]base mixture:

15 neodymium atoms,
76 iron atoms,
5 boron atoms,
2 copper atoms.

The intrinsic coercive yield obtained is 835 kA/m for a remanent induction of 1.15 Tesla. The magnetic maximum energy product obtained is then 238 kJ/m$^3$.

Despite the reservations expressed in the above-mentioned publication it is observed, therefore, that the use of neodymium in the scope of the process according to the invention enables permanent magnets of very high magnetic performance to be obtained.

EXAMPLE 9

The previous example is repeated with the atomic centesimal composition of the following base mixture:

17 neodymium atoms,
77 iron atoms,
5 boron atoms,
1 copper atom.

The magnetic properties obtained at slightly inferior to the two previous examples, in fact an intrinsic coercive field of 800 kA/m is observed for a remanent induction of 1 Tesla, the magnetic maximum energy product obtained being 159 kJ/m$^3$.

EXAMPLE 10

The previous example is repeated by modifying, respectively, the compositions of iron and of copper, namely:

74 iron atoms,
4 copper atoms.

The intrinsic coercive field obtained is then 835 kA/m for a remanent induction of 0.95 Tesla. The maximum energy product obtained is 243 kJ/m$^3$. It is observed, therefore, in the scope of the strict application of the four elements, neodymium-iron-boron-copper, that the maximum in the magnetic properties occurs for an atomic centesimal concentration of copper of approximately 2.

It should be noted that the temperature of the refining is not less than 500° C. so as to be at least in the region of the melting of the neodymium-copper eutectic. However, it has been found that around 800° C. the results were substantially the best.

These results are grouped together in the following table.

| COMPOSITION | Hci (kA/m) | Br (T) | $(BH)_max$ (kJ/m$^3$) |
|---|---|---|---|
| $Nd_{16}Fe_{76}B_6Al_2$ | 756 | 0.8 | 103.5 |
| $Nd_{16}Fe_{76}B_6Co_2$ | 597 | 0.88 | 87.5 |
| $Nd_{16}Fe_{78}B_6$ | 600 | 0.9 | 95.5 |
| $Pr_{17}Fe_{76,5}B_5Cu_{1.5}$ | 800 | 1.25 | 288 |
| $Nd_{17}Fe_{76.5}B_5Cu_{1.5}$ | 48 | 0.29 | 3.2 |
| $Nd_{17}Fe_{76.5}B_5Cu_{1.5}$ | 230 | 0.99 | 78.8 |
| $Nd_{17}Fe_{76}B_5Cu_2$ | 955 | 1.01 | 200 |
| $Nd_{15}Fe_{77}B_5Cu_2$ | 835 | 1.15 | 238 |
| $Nd_{17}Fe_{77}B_5Cu$ | 800 | 1 | 159 |
| $Nd_{17}Fe_{74}B_5Cu_4$ | 835 | 0.95 | 143 |

It is observed therefore that introducing copper into the base mixture, at a level of approximately 2 atomic %, enables the coercivity and the remanence of the magnets thus obtained to be significantly increased, as a consequence of the increase in the anisotropy of the magnets obtained. It is noted, in particular, that there is a large increase in the maximum energy product of the magnets.

In all the previous examples it is also possible to introduce dysprosium at the level of 0.5 to 2 atomic %, especially in the scope of use of these magnets at higher temperatures. In fact, the latter enables the coercivity, and therefore the operating temperature, of the magnets obtained to be increased.

Moreover, it is possible to substitute copper by other metals such as silver, gold or paladium.

The process according to the invention has numerous advantages in relation to the process mentioned in the preamble. It may be noted that it is possible to use a simple and low cost process employing neodymium, a rare earth much more abundant than praseodymium and in fact enabling permanent magnets to be obtained with magnetic properties equal to, indeed better than those described in the other processes but with a distinctly reduced production cost. In fact, taking into account the relative abundance of neodymium in nature, it is possible to reduce the cost of such magnets by a factor of 5.

It is also possible to mention the other advantages inherent to the actual process of the invention, especially the absence of danger for the environment, such as the risk of explosion or fire, since there is no recourse to powder metallurgy.

In other words, this process using a mixture based on neodymium-iron-boron-copper enables low cost permanent magnets to be obtained, having high magnetic performance and capable of being made easily on an industrial scale.

We claim:

1. A process for the preparation of permanent magnets by the steps of:

in a bulk alloy comprising copper-neodymium-iron-boron that occurs in a first brittle solid phase and in a second liquid phase in a temperature range;

forging said alloy at a temperature in said temperature range at a deformation rate of at least ten until grains of said partially substituted alloy are refined into particles having a reduced size to produce a welded alloy; and thereafter annealing said welded alloy.

2. The process of claim 1, wherein said partially substituted alloy comprises 0.5 to 4 atomic percent of copper.

3. The process of claim 1, wherein said partially substituted alloy comprises 1.0 to 2.5 atomic percent of copper.

4. The process of claim 3, wherein said partially substituted alloy comprises about 2 atomic percent of copper.

5. The process of claim 1, wherein said partially substituted alloy further comprises dysprosium.

6. The process of claim 5, wherein said partially substituted alloy comprises 0.5–2.0 atomic percent of dysprosium.

7. A process for the preparation of permanent magnets by the steps of:

heating a bulk alloy comprising iron-boron-neodymium-copper to a temperature of about 800° C. for about five minutes, said bulk alloy being in a solid phase and in a liquid phase at said temperature;

forging said heated alloy at a deformation rate of at least ten to disrupt magnetic crystal grains therein and to reduce the crystals in size to produce a welded alloy; and thereafter annealing said welded alloy.

8. The process according to claim 7, wherein said step of annealing is carried out in the presence of a nonreactive gas.

9. The process of claim 7, wherein said step of annealing is carried out in a vacuum.

10. The process of claim 7, wherein said partially substituted alloy comprises 0.5 to 4 atomic percent of copper.

11. The process of claim 7, wherein said partially substituted alloy comprises 1.0 to 2.5 atomic percent of copper.

12. The process of claim 11, wherein said partially substituted alloy comprises about 2 atomic percent of copper.

13. The process of claim 7, wherein said partially substituted alloy further comprises dysprosium.

14. The process of claim 13, wherein said partially substituted alloy comprises 0.5–2.0 atomic percent of dysprosium.

15. The process of claim 1, wherein said step of forging is performed by hammering.

16. The process of claim 15, wherein said annealed welded alloy has an intrinsic coercive force of at least 800 kA/m.

17. The process of claim 7, wherein said step of forging is performed by hammering.

18. The process of claim 17, wherein said annealed welded alloy has an intrinsic coercive force of at least 800 kA/m.

19. A process for the preparation of permanent magnets by the steps of:

in a bulk alloy comprising copper-neodymium-iron-boron that occurs in a first brittle solid phase and in a second liquid phase in a temperature range, said bulk alloy having magnetic crystals therein;

heating said alloy to a temperature in said temperature range;

forging said heated alloy at a rate that is sufficient to shatter said magnetic crystals until grains of said heated alloy are refined into particles having a reduced size to produce a welded alloy; and thereafter annealing said welded alloy.

20. The process of claim 19, wherein said temperature is about 800° C.

21. The process of claim 20, wherein said step of forging is performed by hammering.

* * * * *